US005570168A

United States Patent [19]

Koga et al.

[11] Patent Number: 5,570,168

[45] Date of Patent: Oct. 29, 1996

[54] DEVELOPMENT PROCESS

[75] Inventors: Yoshiro Koga; Masanao Kunugi, both of Suwa, Japan

[73] Assignee: Seiko Epson Corporation, Tokyo-to, Japan

[21] Appl. No.: 418,655

[22] Filed: Apr. 10, 1995

Related U.S. Application Data

[62] Division of Ser. No. 756,997, Sep. 9, 1991, Pat. No. 5,438,395.

[30] Foreign Application Priority Data

| | | | |
|---|---|---|---|
| Sep. 10, 1990 | [JP] | Japan | 2-239262 |
| Sep. 10, 1990 | [JP] | Japan | 2-239263 |
| Sep. 10, 1990 | [JP] | Japan | 2-239264 |
| Sep. 10, 1990 | [JP] | Japan | 2-239265 |
| Sep. 10, 1990 | [JP] | Japan | 2-239266 |

[51] Int. Cl.[6] ..... G03G 15/09

[52] U.S. Cl. ..... 355/253; 355/259

[58] Field of Search ..... 355/245, 259, 355/251, 253; 118/656, 657; 430/106.6

[56] References Cited

U.S. PATENT DOCUMENTS

| | | | |
|---|---|---|---|
| 4,616,918 | 10/1986 | Kohyama | 118/656 |
| 4,675,266 | 6/1987 | Fujiwara | 118/653 |
| 4,978,597 | 12/1990 | Nakahara | 355/252 X |
| 4,987,454 | 1/1991 | Natsuhara | 355/259 |
| 5,012,289 | 4/1991 | Aldrich | 355/259 X |
| 5,025,272 | 6/1991 | Haneda | 346/153.1 |
| 5,143,810 | 9/1992 | Nozawa | 430/106.6 |
| 5,149,914 | 9/1992 | Koga et al. | 118/657 |
| 5,177,537 | 1/1993 | Okano | 355/259 |
| 5,223,365 | 6/1993 | Yamamoto | 430/106.6 |
| 5,438,395 | 8/1995 | Koga et al. | 355/253 |

FOREIGN PATENT DOCUMENTS

| | | |
|---|---|---|
| 0447045 | 9/1991 | European Pat. Off. . |
| 1522558 | 9/1969 | Germany . |
| 3428728 | 2/1985 | Germany . |
| 55-118052 | 9/1980 | Japan . |
| 58-105266 | 6/1983 | Japan . |
| 62-283370 | 12/1987 | Japan . |
| 1-169472 | 7/1989 | Japan . |

*Primary Examiner*—Nestor R. Ramirez
*Attorney, Agent, or Firm*—Ladas & Parry

[57] ABSTRACT

An apparatus for developing an image with spherical toner particles has a latent image carrier on which a latent image is formed by a potential contrast, a toner transporter having a surface for transporting the spherical toner particles to the latent image carrier and an elastic blade having a surface for passing the spherical toner particles transported by the toner transporter through a gap between the surfaces of the toner transporter and elastic blade for forming a thin toner layer which is charged. The toner transporter is elastically deformed for the surface thereof to be brought into pressure contact with the latent image carrier and develop an electrostatic latent image on the latent image carrier with the thin toner layer which is charged. Surface roughnesses of the elastic blade and of the toner transporter are different from each other. The toner particles are rotated between the elastic blade and the toner transporter and charged electrostatically. At least some of the toner particles may also satisfy the equation b/a=1 to 1.5 where "a" is the longest length of the minor axis and "b" is the longest length of the major axis of at least one cross section of the toner particles.

22 Claims, 8 Drawing Sheets

DEVELOPMENT PROCESS

This is a divisional of application Ser. No. 07/756,997 filed on Sep. 9, 1991 now U.S. Pat. No. 5,438,395.

BACKGROUND OF THE INVENTION

1. Field of the Invention

This invention relates to a contact development process, in which a toner transporting means is brought into pressure contact with a latent image carrier to develop an electrostatic latent image by a toner.

2. Description of the Related Art

In conventional development processes such as a process disclosed in Japanese Patent Laid-Open Publication No. 118052/80, an image is developed by flying a toner from a toner transporting means to a latent image carrier without bringing these two supporters into contact with each other. In a process of this type, a spherical toner has been used to obtain improved flying ability. It is, however, difficult to obtain a high resolution image by this non-contact development process because the distance (gap) between the latent image carrier and a development electrode is large.

As a so-called contact development process, Japanese Patent Laid-Open Publication No. 114163/82 and No. 226676/88 disclose a process in which a single-component non-magnetic toner is employed. Although a development electrode can give a sufficiently high effect, a toner is charged insufficiently in the above contact development process. Therefore, a development density becomes unstable. In addition, some toner particles are charged to an opposite polarity so that the toner particles adhere to no image portion on a latent image carrier (hereinafter referred to as "fogging").

In order to solve the above problems, a contact development process in which a magnetic toner is used has been newly proposed in Japanese Patent Laid-Open Publication No. 58321/90, the disclosure of which is hereby incorporated by reference. The present invention is to further improve this development process.

SUMMARY OF THE INVENTION

Accordingly, an object of this invention is to provide a contact development process, in which a toner is charged rapidly and sufficiently.

The present invention provides a development process comprising the steps of smoothing a spherical toner supplied on a toner transporting means by an elastic blade to form a thin toner layer, and bringing the thin toner layer on the toner transporting means into pressure contact with a latent image carrier to develop an electrostatic latent image formed on the latent image supporter by the toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
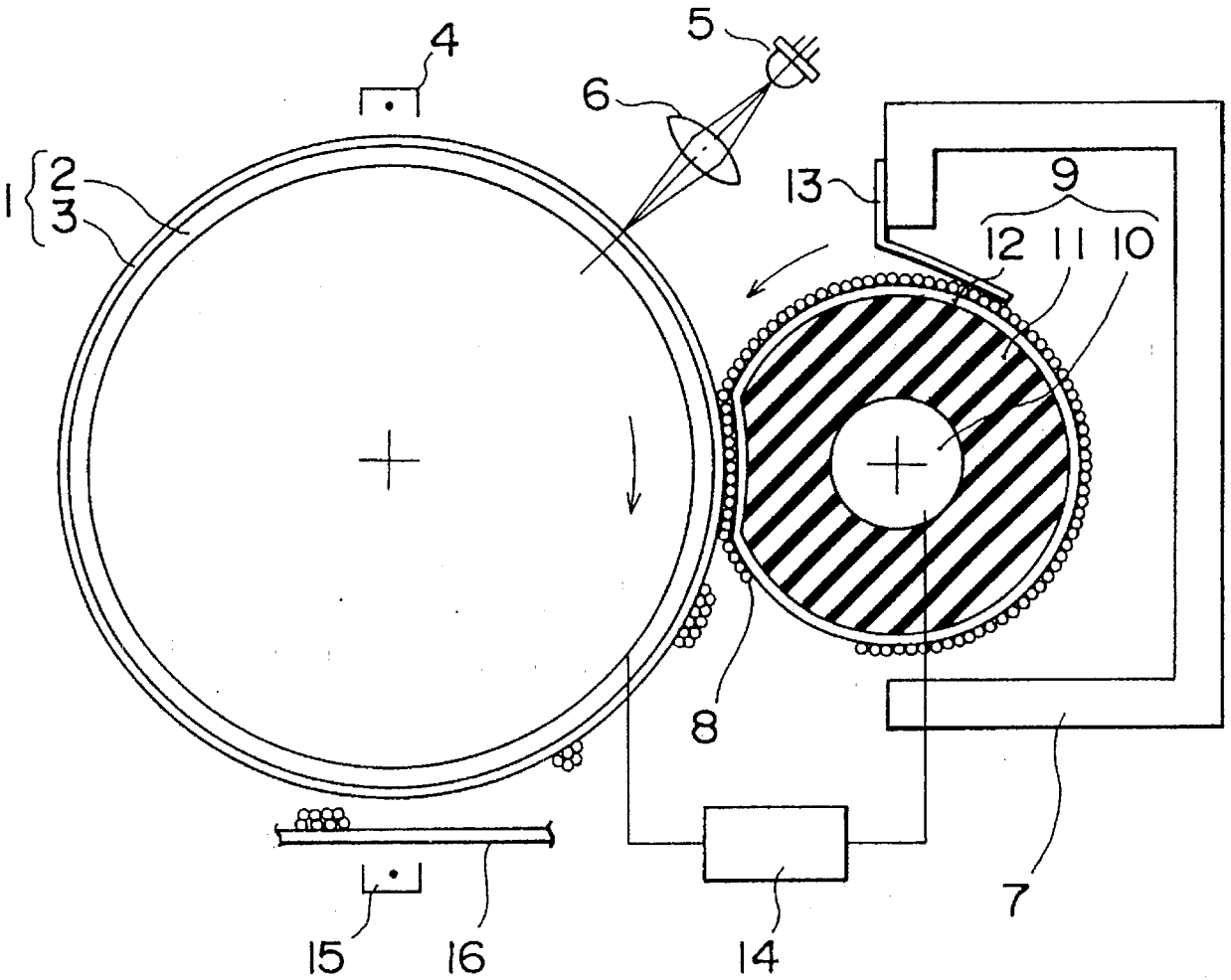
FIG. 1 is a cross-sectional view of an image developing apparatus for use with the development process according to the present invention, in which a non-magnetic toner is used.

Referring now to the drawings, wherein like reference numerals designate identical or corresponding parts throughout the several views, the present invention will be explained in detail.

FIG. 1 is a cross-sectional view of an image developing apparatus for use with the development process of the present invention, in which a non-magnetic toner is used. A latent image carrier 1 is prepared by forming an organic or inorganic photoconductive layer 3 on an electroconductive substrate 2. The photoconductive layer 3 is electrostatically charged by an electrifier 4 such as a corona charger or an electrifying roller. Thereafter, light is selectively applied to the photoconductive layer 3, corresponding to image information, by the combination use of a light source 5 such as laser or LED, and an optical image formation system 6. An electrostatic latent image is finally formed on the photoconductive layer 3 by a potential contrast thus caused.

In a development device 7, a toner 8 is transported to develop the electrostatic latent image. The development device 7 includes a toner transporting means 9 and an elastic blade 13. The toner transporting means 9 is composed of a shaft 10, and an elastic layer 11 and an electroconductive layer 12 which are concentrically provided on the shaft 10 as shown in the figure. Since the elastic layer 11 is made from an elastic material, the toner transporting means 9 can be brought into contact with the latent image carrier 1 with a predetermined pressure. Examples of materials preferably usable for preparing the elastic layer 11 include natural rubber, silicone rubber, urethane rubber, butadiene rubber, chloroprene rubber, neoprene rubber, acrylonitrile-butadiene rubber (NBR), and elastomers such as a styrol resin, a vinyl chloride resin, a polyurethane resin, a polyethylene resin and a methacrylic resin. The elastic blade 13 is a plate made from a non-magnetic or magnetic metal, or a resin, and is in pressure contact with the toner transporting means 9.

In the developing device 7, the toner 8 is deposited on the electroconductive layer 12 of the toner transporting means 9 by a weak image force, and is transported as the toner transporting means 9 rotates. The toner 8 receives frictional force when it passes between the toner transporting means 9 and the elastic blade 13. As a result, the toner is stably charged to a predetermined polarity, and, at the same time, a thin layer of the toner is formed on the toner transporting means 9. The state of the toner 8 when it passes between the toner transporting means 9 and the elastic blade 13 will now be explained in detail by referring to FIG. 2 and FIG. 3.

Figure 2:
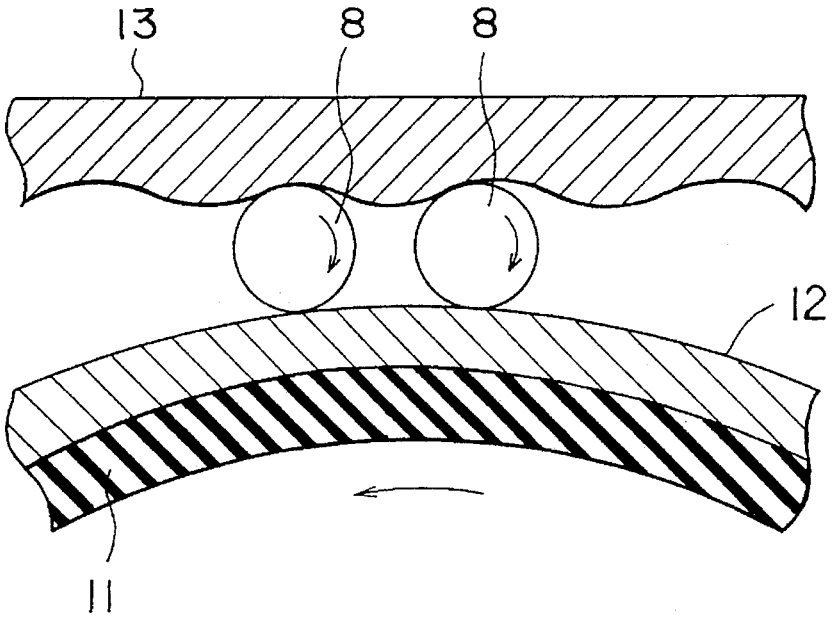
FIG. 2 is an enlarged cross-sectional view showing a portion of an elastic blade which is in pressure contact with a toner transporting means.
Figure 3:
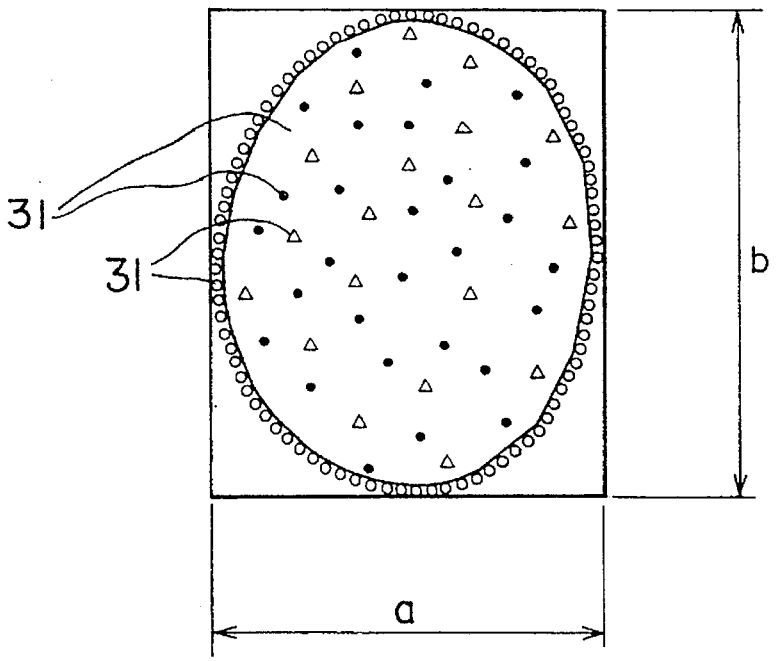
FIG. 3 is a cross-sectional view of a toner for use in the development process according to the present invention.
Figure 9:
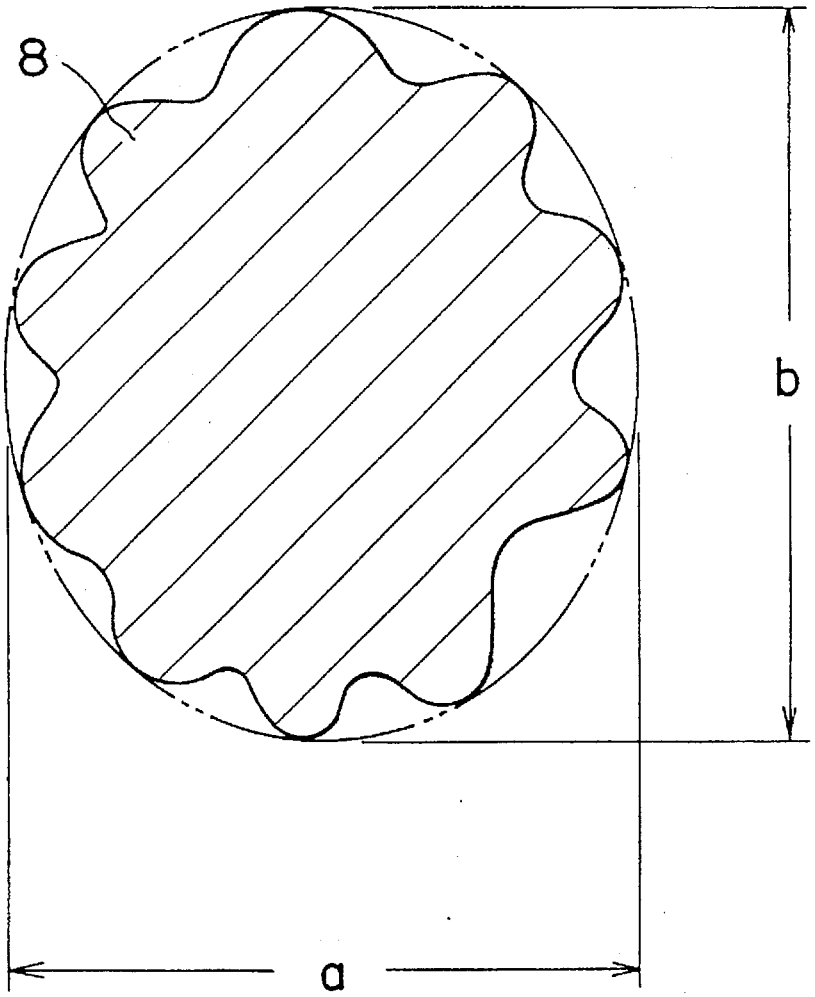
FIG. 9 is a cross-section view of a toner for use in the development process according to the present invention which toner has some projections on its surface.

FIG. 2 is an enlarged cross-sectional view of a portion of the elastic blade 13 which is in pressure contact with the toner transporting means 9. The toner 8 is pressed on the toner transporting means 9 by the elastic blade 13. The toner transporting means 9 rotates in the direction of the arrow as shown in the figure, but the elastic blade 13 is fixed. The toner 8 existing between the toner transporting means and the elastic blade is therefore rotates in the direction of the arrow as shown in the figure. When the toners spherical, it can rotate regularly. However, if the toner is not spherical, it rotates irregularly. As a result, each particle of the toner acquires different amount of electrostatic charge. FIG. 3 is a cross-sectional view of a toner which is usable as the toner 8 in the development process of the present invention. In the present disclosure, a "spherical toner" refers to a toner which can satisfy the equation of b/a=1 to 1.5, wherein "a" is the length of the minor axis, and "b" is the length of the major axis of the cross section of the toner particle as shown in FIG. 3. A toner which can satisfy the equation of b/a=1 to 1.3 is more preferable. When a toner has some projections on its surface, the minor axis "a" and the major axis "b" may be measured as shown in FIG. 9.

According to another embodiment of the present invention, it is preferable that the surface roughness of the elastic blade and that of the toner transporting means are different from each other. For example, as shown in FIG. 3, the elastic blade 13 has a surface which is rougher than that of the toner transporting means 9. In the present disclosure, the roughness means that a surface has concave and convex which can hold and rotate the toner efficiently. In the case where the toner 8 can easily slide on the toner transporting means 9, but cannot easily slide on the elastic blade 13, the toner 8 cannot pass between the toner transporting means 9 and the elastic blade 13 in a short time, so that it can come in full contact with both the toner transporting means and the elastic blade. The toner 8 can thus be charged uniformly. It is also preferable that a coefficient of friction between the surface of the toner and that of the elastic blade or that of the toner transporting means be large. The large coefficient of friction may increase the frictional force so that the toner 8 can be charged efficiently.

As the toner transporting means 9 rotates, the thin layer of the toner 8 charged in the above manner is transferred to a development gap area where the latent image carrier 1 and the toner transporting means 9 are close to each other. At this development gap, a development electric field is produced by the potential contrast generated on the latent image carrier 1, and a development bias application means 14. The charged toner 8 is deposited on the latent image carrier 1 corresponding to the development electric field. The electrostatic latent image is thus developed by the toner. When the toners are charged uniformly with a large amount of static electricity which may be almost the same as the amount of saturated charge of the toner, toner images with a high density and high resolution can be stably obtained repeatedly.

The toner image 8 is transferred on recording paper 16 by an image transfer device 15 such as a corona transfer device or transfer roller, and then fixed thereon by heat or pressure.

Figure 4:
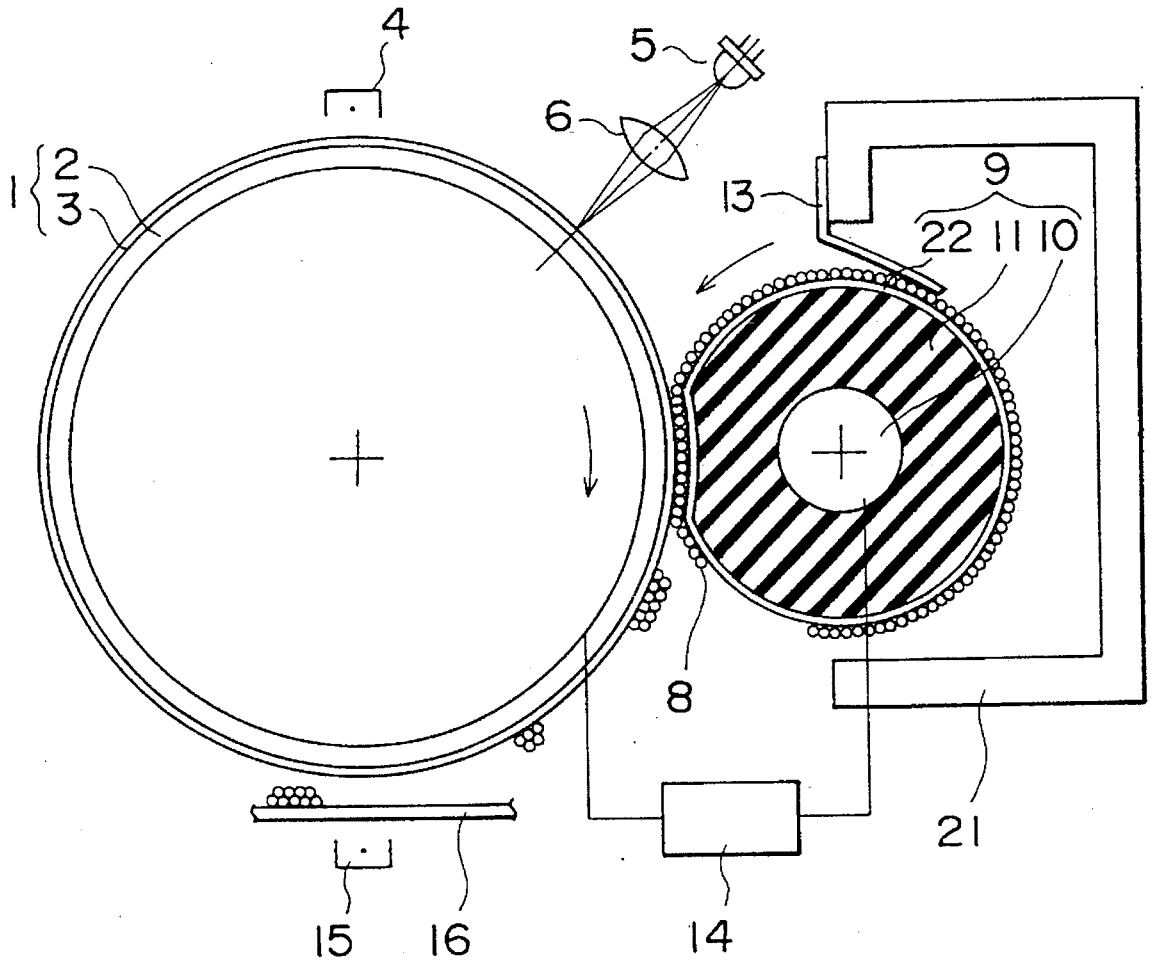
FIG. 4 is a cross-sectional view of an image developing apparatus for use with the development process according to the present invention, in which a magnetic toner is used.

FIG. 4 is a cross-sectional view of an image developing apparatus 21 for use with the development process of the present invention, in which a magnetic toner is used. This apparatus is basically the same as the apparatus shown in FIG. 1 except that a magnetic field generating layer 22 is provided instead of the electroconductive layer 12. In this apparatus, a magnetic toner is directly supported on the toner transporting means 9 by leakage magnetic flux existing at the circumference of the magnetic field generating layer 22. The magnetic field generating layer 22 can be prepared using any known magnetic recording material or material for a magnet. Preferred examples of the material for preparing the magnetic field generating layer 22 include magnetic materials comprising at least one element of Fe, Ni, Co, Mn or Cr. More specifically, $\gamma$-$Fe_2O_3$, Ba—Fe, Ni—Co, Co—Cr, Mn—Al are preferred. Resins such as styrene resins, acrylic resins, styrene-acrylic resins, polyester resins and epoxy resins containing magnetic powder made of magnetic materials mentioned above are also preferred as the magnetic field generating layer 22. The magnetic field generating layer 22 is required to have such a thickness that the layer 22 can have flexibility so that the toner transporting means 9 can be brought into pressure contact with the latent image carrier 1. For instance, when the layer 22 is prepared one of the above materials, the thickness of the layer is preferably 100 μm or less, more preferably 10 μm or less. It is also preferable that the magnetization inversion pitch of the magnetic field generating layer 22 be as small as possible to obtain an image with an even density.

In the apparatus shown in FIG. 1 and FIG. 4, it is preferable to provide an intermediate layer between the two layers provided on the shaft of the toner transporting means 9, and a protective layer on the surface of the toner transporting means 9. It is preferable an intermediate layer which can promote the adhesion between the two layers and the protective layer which can protect the surface of the toner transporting means 9.

Figure 5:
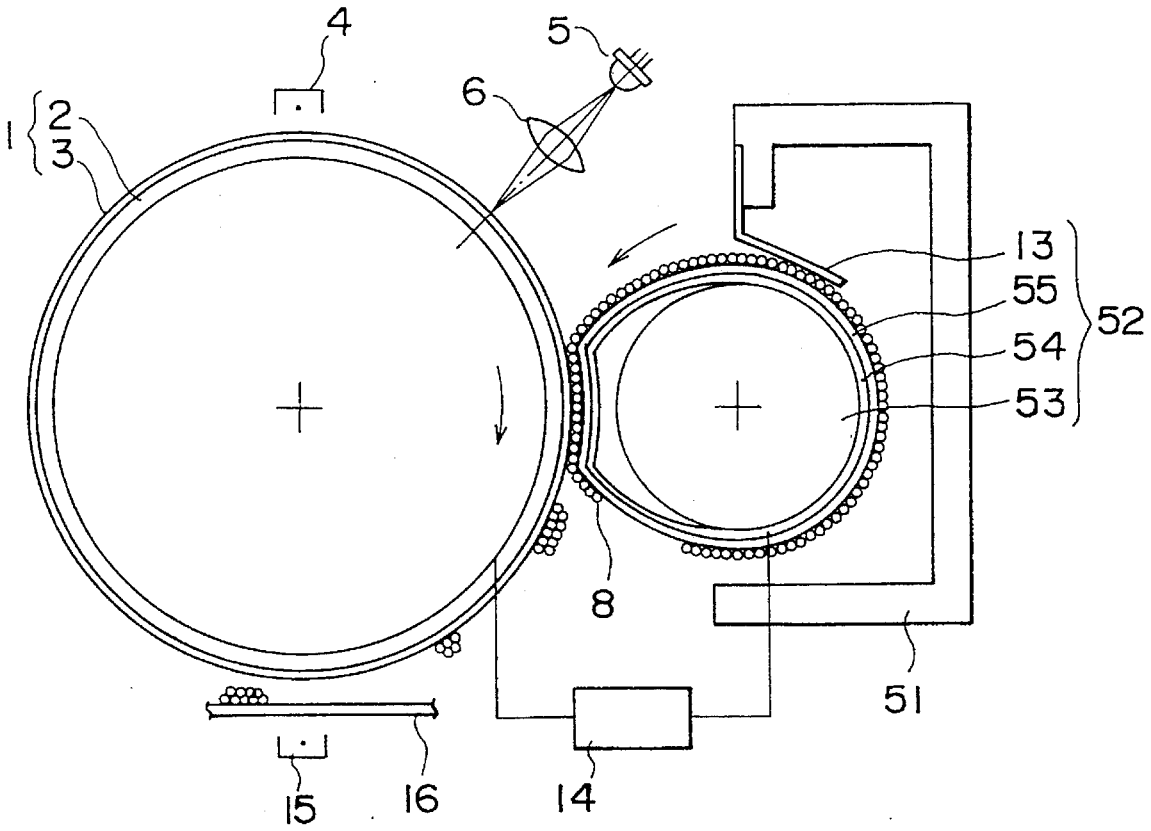
FIG. 5 is a cross-sectional view of another image developing apparatus for use with the development process according to the present invention.

The toner transporting means 52 of a device 51 may also be composed of a driving roller 53 and a cylindrical thin layer 54 with an excessive length provided on the outer surface of the driving roller 53 as shown in FIG. 5. The thin layer 54 is in contact with the latent image carrier 1 with a predetermined pressure. A magnetic field generating layer 55 is provided on the thin layer 54, and a magnetic toner is supported thereon by a magnetic field generated by the layer 55.

A toner for use in the development process according to the present invention is required to be spherical. However, the toner can be prepared by any known method which is adopted for the preparation of toners usable for conventional contact development processes, such as a crushing method, a spray drying method, a mechanochemical method or a polymerizing method.

For instance, a toner as shown in FIG. 3 is obtainable by a crushing method. A resin which serves as a binder, such as a polyester resin or a styrene-acrylic resin, a magnetic powder such as ferrite, a coloring agent such as carbon black, a wax having a low molecular weight such as polypropylene, and some other additives are mixed, and kneaded. The resulting mixture is crushed, followed by classification, thereby obtaining particles. An external additive agent such as silicon dioxide or titanium dioxide may be deposited on the particles obtained. The particles are made into spherical after the crushing, the classification, or the deposition of the agent. The sphering treatment can be carried out with a method which applies a mechanical shearing force to the particles using ball mills or a high speed flow type of stirrer, and a method which applies heat to the particles using a hot air flow or a fluid bed.

Figure 6:
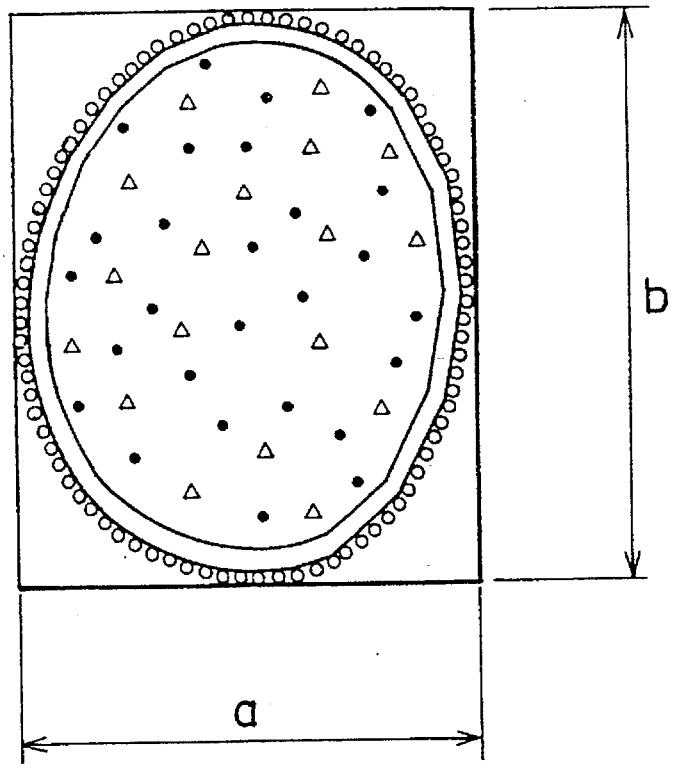
FIG. 6 is a cross-sectional view of a microcapsulated toner suitable for the development process according to the present invention.

A microcapsulated toner comprising a core particle, and a shell which encloses the core particle is also usable in the development process according to the present invention. In this case, the shell is prepared by using a material which belongs to a frictional electrification series different from the one to which the material of the surface of the toner transporting means and/or that of the elastic blade belongs. A cross-sectional view of the microcapsulated toner is shown in FIG. 6. In the case where the shell of the microcapsulated toner is prepared by using the above-described material, the toner can be efficiently charged when the toner supplied on the toner transporting means is pressed by the elastic blade. This is because when those materials which are different from each other in a frictional electrification series are rubbed with each other, static electricity is generated and accumulated efficiently. A preferable thickness of the shell lies the range of 0.1 μm to 1.0 μm.

When the elastic blade is urethane resin and/or the surface of the toner transporting means is a metallic thin film, it is preferable that the surface of the toner particles (or the shell of the microcapsulated toner) be styrene-acrylic resin or polyester resin. When the elastic blade is a metallic thin film and/or the surface of the toner transporting means is a resin containing magnetic particles, it is preferable that the surface of the toner particles (or the shell) be polyester resin The core particle of the microcapsulated toner may comprise, as shown in FIG. 6, a binder resin, a magnetic powder, a coloring agent and a releasing agent which are incorporated into conventionally known toners.

Usable as the binder resins, for instance, are polystyrene and copolymers, e.g. hydrogenated styrene resins, styrene/isobutylene copolymers, ABS resins, ASA resins, AS resins, AAS resins, ACS resins, AES resins, styrene/p-chlorostyrene copolymers, styrene/propylene copolymers, styrene/butadiene crosslinked polymers, styrene/butadiene/chlorinated paraffin copolymers styrene/allylalcohol copolymers, styrene/butadiene rubber emulsions, styrene/maleate copolymers and styrene/maleic anhydride copolymers; (meth)acrylic resins and their copolymers as well as styrene/acrylic resins and their copolymers, e.g. styrene/acrylic copolymers, styrene/dimethylaminoethyl methacrylate copolymers, styrene/butadiene/acrylate copolymers, styrene/methacrylate copolymers, styrene/n-butylmethacrylate copolymers, styrene/diethylaminoethyl methacrylate copolymers, styrene/methyl methacrylate/n-butyl acrylate copolymers, styrene/methyl methacrylate/butyl acrylate/N-(ethoxymethyl) acrylamide copolymers, styrene/glycidyl methacrylate copolymers, styrene/butadiene/dimethylaminoethyl methacrylate copolymers, styrene/acrylate/maleate copolymers, styrene/methyl methacrylate/2-ethylhexyl acrylate copolymers, styrene/n-butyl acrylate/ethyl glycol methacrylate copolymers, styrene/n-butyl methacrylate/acrylic acid copolymers, styrene/n-butyl methacrylate/maleic anhydride copolymer and styrene/butyl acrylate/isobutyl maleic half ester/divinylbenzene copolymers; polyester and its copolymers; polyethylene and its copolymers; epoxy resins; silicone resins; polypropylene and its copolymers; fluorocarbon resins; polyamide resins; polyvinyl alcohol resins; polyurethane resins; and polyvinyl butyral resins. It is noted that these resins may be used alone or blended together in combination of two or more.

Besides the aforesaid resins, waxes, etc. may be used as the binder components. For instance, use may be made of a plant type of ;naturally occurring waxes such as candelilla wax, carnauba wax and rice wax; an animal type of naturally occurring waxes such as beeswax and lanolin; a mineral type of naturally occurring waxes such as montan wax and ozokelite; a petroleum type of naturally occurring waxes such as paraffin wax, microcrystalline wax and petrolatum wax; synthetic hydrocarbon waxes such as polyethylene wax and Fischer-Tropsch wax; modified waxes such as derivatives of montan wax and paraffin wax; hydrogenated waxes such as hardened castor oil and its hydrogenated derivatives; synthetic waxes; higher fatty acids such as stearic and palmitic acids; polyolefins such as low-molecular-weight polyethylene, polyethylene oxide and polypropylene; and olefinic copolymers such as ethylene/acrylic acid copolymers and ethylene/acrylate copolymers and ethylene/vinyl acetate copolymers. These waxes may be used alone or in combination of two or more.

As the coloring matter use may be made of black dyes and pigments such as carbon black, spirit black and nigrosine. For coloring purposes use may be made of dyes or pigments such as phthalocyanine, Rhodamine B Lake, Solar Pure Yellow 8G, quinacridone, Tungsten blue, Indunthrene blue, sulfone amide derivatives and so on. As the dispersants use may be made of metallic soap, polyethylene glycol, etc., and electron-accepting organic complexes, chlorinated polyester, nitrohumin acid, quaternary ammonium salts, pyridinium salts and so on may be added as the electrification controllers. Besides, magnetic powders for magnetic toners such as $Fe_3O_4$, $Fe_2O_3$, Fe, Cr and Ni, all in powdery forms, may be used.

When the microcapsulated toner is a magnetic toner, it is preferable that the magnetic powder be unexposed to the outside of the shell. If the magnetic powder is exposed to the outside of the shell, the toner will be charged to an opposite polarity, or charged with an insufficient amount of static electricity.

The microcapsulated toner is preferably polarity, or charged with an insufficient amount of static electricity.

The microcapsulated toner is preferably prepared in accordance with a method disclosed in U.S. patent application Ser. No. 07/657,586 and European Patent Application No. 91-301395.9 herein incorporated by reference.

This method is such that resin particles are deposited on the surface of a core particle, and the resulting product is brought into contact with a solvent which can dissolve the resin particles, whereby the resin particles are dissolved to form a resin layer on the core particle. A toner which is suitable for use in the development process of the present invention can thus be obtained. It is not necessary to subject the toner to a sphering treatment, so that the method is advantageous.

Figure 7:
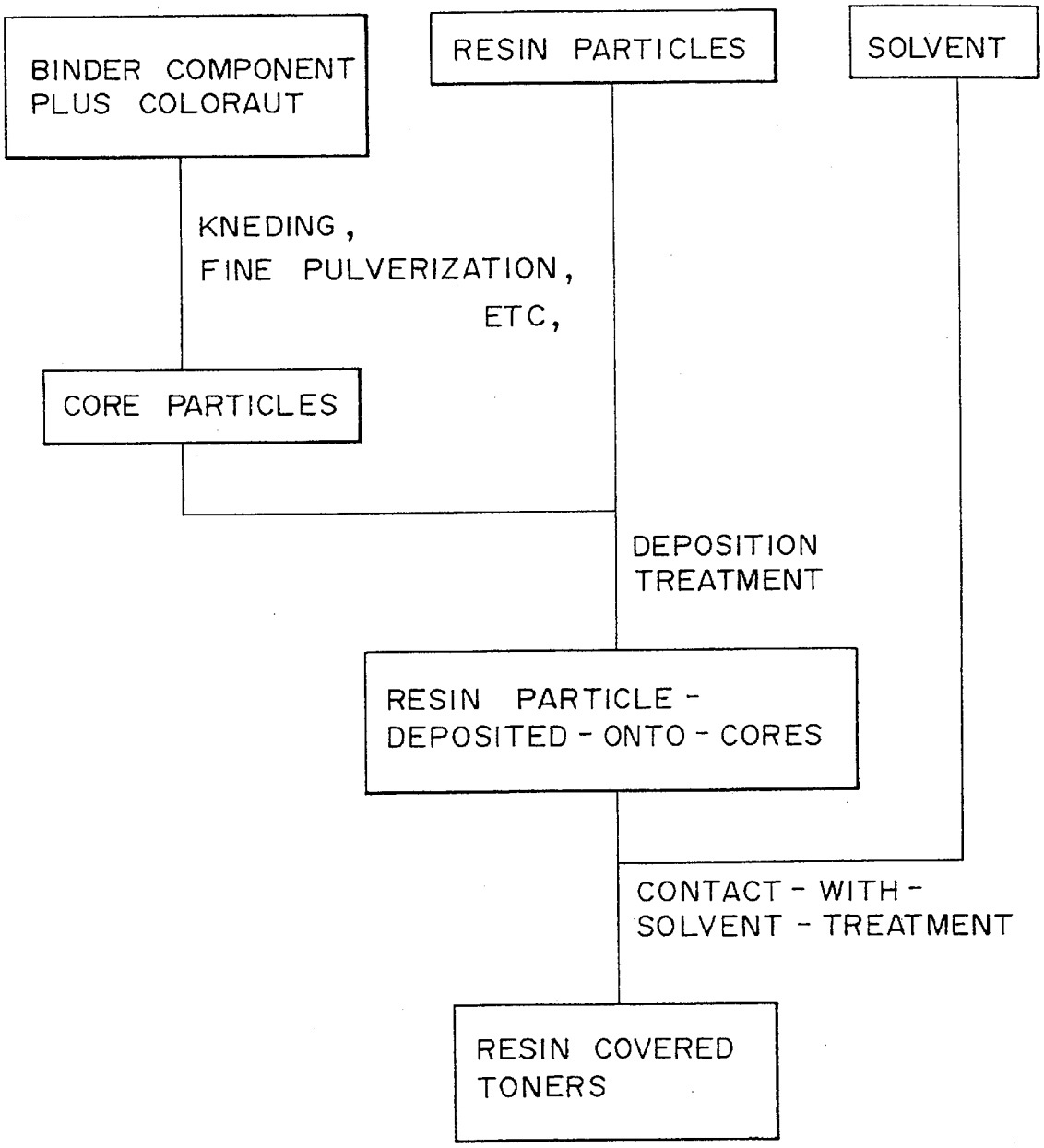
FIG. 7 is a chart depicting the steps for dry Producing toners.

The process for preparing toner particles wherein resin particles are deposited on core particles in dry state will first be explained with reference to FIG. 7. Core particles are first provided. The toner core may be prepared from these raw materials in conventional manner. For instance, it may be obtained by mixing and finely pulverizing such raw materials. Alternatively, it may be obtained by other suitable means such as spray drying and polymerization.

Resin particles are then deposited on core particles thus obtained.

The process may be carried out with ordinary mixers (e.g. ball mills or V-type mixers), or alternatively in mechanochemical reaction manners (using, e.g. a high speed flow type of stirrer) or powdered or fluidized bed manners. Particular preference is given to the mechanochemical reaction type of process making use of a high speed flow type of stirrer. Typical of the high speed flow type of stirrer are a so-called Henschel mixer, Mechanofusion System (made by Hosokawa Micron K. K.), Nara Hybridization System (Nara Kikai Seisakusho K. K.) and Mechanomill (Okada Seiko K. K.).

The core particles on which the resin particles are deposited are then brought into contact with a solvent in which the resin of the resin particles can dissolve. In the present disclosure, the solvent in which the resin of the resin particles can dissolve is used to mean that after contacting the resin particles, the solvent evaporates off, leaving a uniform resin coat on the surface of the core particle. The contact with the solvent can be attained by processes in which the solvent is sprayed into a space where the core particles on which the resin particles are deposited carried with gas stream are in a monodisperse state; they are dispersed in the solvent; they are dispersed in a preliminary solvent incapable of dissolving the particle-forming resin in it and the solvent is sprayed into a space into which the resulting dispersion is sprayed; they are caused to impinge upon or pass through a wall of the solvent jetted in the form of a curtain.

The particles treated with the solvent are then dried in the monodisperse state, whereby microcapsulated toners are obtained.

Figure 8:
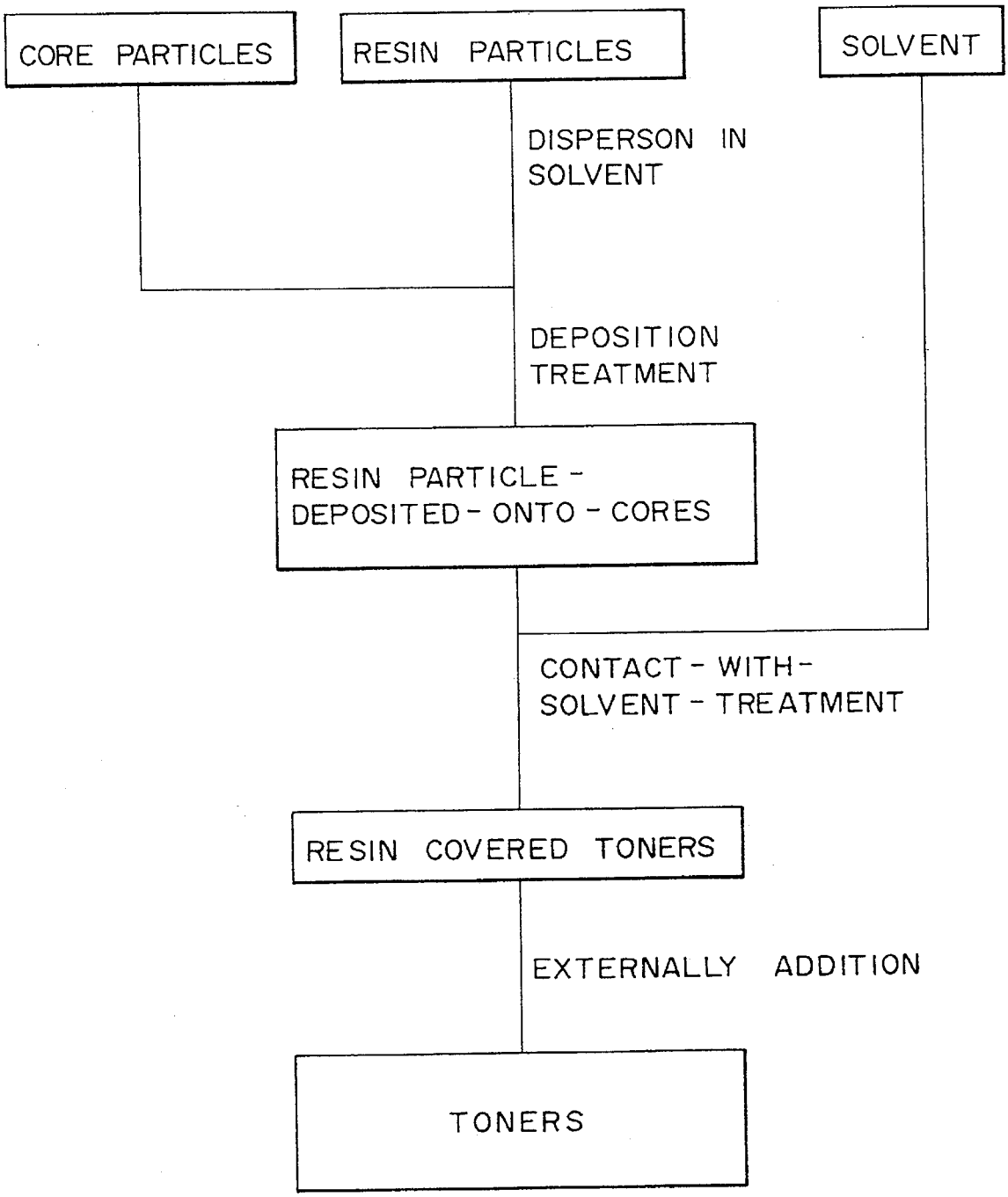
FIG. 8 is a chart depicting the steps for wet Producing toners.

The process for preparing toner particles wherein resin particles are deposited on core particles in wet state will then be explained with reference to FIG. 8. While core particles may be prepared in the same manner described above, this process is advantageous in that the resin particles can be deposited on the core particles made of a material so soft that difficulty can be encountered in handling it by dry processes.

The resin particles are first dispersed in a solvent in which they are not dissolved. Examples of the solvent used to this end are petroleum type solvents such as hexane, heptane, Isopar and kerosene, water or the like. In order to improve the dispersibility of the resin particles, it is also possible to add to them surface active agents. Resin particles prepared by polymerization may also be used in the form of a dispersion, if the resulting resin particle dispersion is rid of emulsifiers, stabilizers, polymerization initiators, etc. as by dialysis.

The thus obtained resin particle dispersion is then mixed with core particles so as deposit the resin particles onto them. In this case, the toner core may be either in a powdery form or in a dispersion state in the presence of a solvent. Deposition may be achieved by the wet milling, coupling or hetero-coagulation process. When relying upon the wet milling process, the particle size ratio between the core particles and the resin particles should preferably be equal to or higher than 5. In the case of the coupling agent process, not only is that ratio equal to or higher than 3, but it is also required that the core particles contain, or be treated on their surfaces with, coupling agents such as silane, titanium, chromium, aluminium, organic phosphorus and silyl peroxide, while the resin particles used include groups capable of reacting with the functional groups of the coupling agents, e.g. amino, aldehyde, ester, epoxy, carboxy, chloromethyl, acid amide, hydroxyl, thiol or like groups. With the hetero-coagulation process, that ratio should preferably be equal to or higher than 3. Also preferably, composition control should be performed in such a way that the zeta potentials of the cores 1 and resin particles 11 are opposite in polarity to each other.

The particles thus obtained are then allowed to contact with the solvent. In the case where the resin of resin particle dissolves in the solvent at a slow rate, the contact may be preferably carried out by filtration drying or spray drying of the solvent in which the particles are dispersed. In the case where the resin of resin particle dissolves in the solvent at a fast rate, the contact may be preferably carried out by the process in which the solvent is sprayed into a space where the dispersion of the particles are sprayed.

The toner particles can be used as a toner without further treatments. If required, the toner may be treated on its surface with electrification controllers, fluidity improvers and the like.

A microcapsulated toner which is preferably usable in the development process of the present invention can also be prepared by a method in which a core particle with resin particles deposited thereon is brought into contact with hot air to form a resin layer on the core particle. More specifically, resin particles are deposited on a core particle in the same manner as described in the above. The resulting product is made into a primary particle, and then brought into contact with hot air. The contact with hot air is preferably conducted in such a manner that the core particles on which the resin particles are deposited are sprayed in hot air. The temperature and the amount of the hot air can be determined depending upon the kind of the resin particles employed. However, the temperature of the hot air is preferably from 150° to 600° C., more preferably from 250° to 500° C.; and the amount of the hot air is preferably 50 to 300 l/min, more preferably 100 to 200 l/min. It is preferable to supply the core particles on which the resin particles are deposited in a stream of the hot air with a rate of 50 to 500 g/hr.

Other features of this invention will become apparent in the course of the following description of exemplary embodiments, which are given for illustration of the invention and are not intended to be limiting thereof.

EXAMPLE A1

(Preparation of Core Particles)

Core particles were prepared by using a mixture consisting of the following components:

| | |
|---|---|
| Styrene-acrylic copolymer | 91% by weight |
| Azo dye containing metal | 3% by weight |
| Carbon black | 2% by weight |
| Polypropylene wax | 4% by weight |

The mixture was kneaded by a twin-screw extruder, and roughly crushed. The crushed product was then finely pulverized by a jet pulverizer, followed by classification, thereby obtaining core particles with sizes between 5 μm and 20 μm (average particle size: 10 μm).

(Sphering treatment)

The particles thus obtained were sprayed by a nozzle in hot air under the following conditions:

Temperature of hot air: 400° C.

Amount of hot air: 150 l/min

Supplying rate of the particles: 250 g/hr

The particles thus obtained were free from agglomeration, and each particle was existing independently. 1% by weight of silicon dioxide were then externally added to the particles to give toner particles. The angle of repose of the toner particles was 32 degrees. The ratio of the minor axis "a" to the major axis "b" of the cross section of the toner particles, which can show the spheroidicity of the toner particle, was 1:5.

(Image Developing Test)

An image developing test was carried out by using the toner particles and an apparatus show in FIG. 1. The material of the elastic blade was urethane resin and that of the surface of the toner supporter was nickel. A line image of 600 DPI, a character image and a solid image were continuously produced on 10,000 sheets of recording paper. The 600 DPI-image was stably obtained without suffering from thickening of the line image, and the other image were also obtained without undergoing tailing of fogging. All the image obtained had a high optical density of 1.4 or more. Further, the latent image carried itself was free from fogging, so that the amount of waste toner was largely decreased.

COMPARATIVE EXAMPLE A1

The procedure in Example A1 was repeated except that the treatment with hot air was not carried out, whereby comparative toner particles were obtained. The ratio of the minor axis "a" to the major axis "b" of the cross section of the toner particles was 1:2.0. The toner particles thus obtained were subjected to the same image developing test as in Example A1. Obtained images had an optical density of 1.2 or less, and unclear image were produced with fogging and tailing.

COMPARATIVE EXAMPLE A2

The procedure in Example A1 was repeated except that temperature of hot air was changed as shown in the below Table 1, whereby toner particles having various spheroidicity were obtained. The toner particles thus obtained were subjected to the same image developing test as in Example A1. Results are shown in the table.

TABLE 1

| SAMPLE No. | Temperature of hot air | Spheroidicity (b/a) | Obtained Image |
|---|---|---|---|
| 1 | 500° C. | 1.1 | ⊙ |
| 2 | 450° C. | 1.3 | ○ |
| 3 | 200° C. | 2 | × |

Wherein:

⊙ means that images having an optical density of 1.4 or more were obtained on 15,000 sheets of recording paper, ○ means that images having an optical density of 1.4 or more were obtained on 10,000 sheets of recording paper, and × means that images as the same as that of Comparative Example A1 were obtained.

EXAMPLE A2

(Preparation of Core Particles)

Core particles were prepared by using a mixture consisting of the following components:

| | |
|---|---|
| Polyester resin | 59 parts by weight |
| $Fe_3O_4$ | 40 parts by weight |
| Carbon black | 1 part by weight |

The mixture was kneaded by a screw extruder, and roughly crushed after cooling. The crushed product was then finely pulverized by a jet pulverizer, followed by classification, thereby obtaining core particles with sizes between 5 μm and 20 μm (average particle size: 10 μm).

(Sphering treatment)

The particles thus obtained were sprayed by a nozzle in hot air under the following conditions:

Temperature of hot air: 450° C.

Amount of hot air: 150 l/min

Supplying rate of the particles: 250 g/hr

The particles thus obtained were free from agglomeration, and each particle was existing independently. 1% by weight of silicon dioxide were then externally added to the particles to give toner particles. The angle of repose of the toner particles was 34 degrees. The ratio of the minor axis "a" to the major axis "b" of the cross section of the toner particles was 1:3.

(Image Developing Test)

An image developing test was carried out by using the toner particles and an apparatus show in FIG. 4. The material of the elastic blade was rustless steel and that of the surface of the toner supporter was polyurethane containing magnetic powder of Ba—Fe. A line image of 600 DPI, a character image and a solid image were continuously produced on 5,000 sheets of recording paper. The 600 DPI-image was stably obtained without suffering from thickening of the line image, and the other image were also obtained without undergoing tailing of fogging. All the image obtained had a high optical density of 1.4 or more. Further, the latent image carried itself was free from fogging, so that the amount of waste toner was largely decreased.

COMPARATIVE EXAMPLE A3

The procedure in Example A2 was repeated except that the treatment with hot air was not carried out, whereby comparative toner particles were obtained. The ratio of the minor axis "a" to the major axis "b" of the cross section of the toner particles was 1:2.0. The toner particles thus obtained were subjected to the same image developing test as in Example A2. Obtained images had an optical density of 1.2 or less, and unclear image were produced with fogging and tailing.

EXAMPLE B1

(Preparation of Core Particles)

Core particles were prepared by using a mixture consisting of the following components:

| | |
|---|---|
| Polyester resin | 59 parts by weight |
| $Fe_3O_4$ | 40 parts by weight |
| Carbon black | 1 part by weight |

The mixture was kneaded by a screw extruder, and roughly crushed after cooling. The crushed product was then finely pulverized by a jet pulverizer, followed by classification, thereby obtaining core particles with sizes between 5 μm and 20 μm (average particle size: 10 μm).

(Deposition of Resin Particles)

100 parts by weight of the above core particles and 20 parts by weight of resin particles, polybutylmethacrylate particles having a particle size of 0.4 μm and a glass transition temperature of 83° C., were mixed with each other by a mechanofusion system (manufactured by Hosokawa Micron K. K.), thereby depositing the resin particles on the core particles. The amount of the resin particles was 200% when indicated by a covering rate of the resin particles to the core particles. The deposition of the resin particles on the core particles was conducted at a revolution speed of 1500 rpm for 30 minutes.

The particles thus obtained were observed by an electron microscope. As a result, it was confirmed that the resin particles were deposited on the surface of the core particle. Further, by the electron-microscopic observation of the cross section of the particle, it was also confirmed that the resin particles maintaining a spherical shape were slightly embedded in the core particle.

(Treatment with Solvent)

The above particles were then brought into contact with a solvent, acetone, for 1.0 second in the following manner:

Namely, the core particles on which the resin particles had been deposited were jetted from a nozzle, over which acetone was mistily sprayed by a binary nozzle. The resin particles were dissolved by this to form a resin layer. Toner particles covered with the resin layer were thus obtained.

The toner particles thus obtained were free from agglomeration, and each particle was existing independently. The cross section of the toner particle was observed by an electron microscope. As a result, the core particle was found to be covered with a resin layer having a thickness of approximately 0.4 microns. The specific resistance of the toner particle was as sufficiently high as $10^{15}$ Ωcm, which was determined by a pressure cell method in which the toner particle was placed between two electrodes, and a pressure of 15 kg/cm$^2$ was applied thereto to measure a resistance. The angle of repose, which can be an index to fluidity, of the toner particles was 35 degrees, which was determined by an electromagnetic vibration type repose angle measuring instrument. The ratio of the minor axis "a" to the major axis "b" of the cross section of the toner particle (see FIG. 5), which can show the spheroidicity of the toner particle, was 1:1.5.

(Image Developing Test)

An image Developing test was carried out by using the toner thus obtained particles and an apparatus shown in FIG. 4. The material of the elastic blade was rustless steel, and that of the surface of the toner was polyurethane containing magnetic powder. A line image of 600 DPI, a character image and a solid image were continuously produced on 10,000 sheets of recording paper. The 600 DPI-image was stably obtained without suffering from thickening of the line image, and the other images were also obtained without undergoing tailing or fogging. All the images obtained had a high optical density of 1.4 or more. Further, the latent image carrier itself was free from fogging, so that the amount of waste toner was largely decreased.

EXAMPLE B2

By changing the size and the amount of resin particles, toner particles having resin layers with various thicknesses were respectively obtained in the same manner as in Example B1. Polybutylmethacrylate particles with a particle size of 0.2 μm, 0.8 μm and 1.0 μm were respectively used as the resin particles. The amounts of the resin particles employed are shown in the below Table 1. The amount of the core particles employed was 100 parts by weight. The mechano-revolution numbers upon depositing the resin particles on the core particles are shown in the table. The deposition was conducted for 30 minutes. Xylene was employed as the solvent.

As a result, toner particles covered with a resin layer each having a thickness shown in the Table were obtained.

TABLE 2

| Particle Size (μm) | Amount of Resin Particles (parts by weight) | Mechano-Revolution Number (rpm) | Contact Time (seconds) | Thickness of Resin Layer (μm) |
|---|---|---|---|---|
| 0.2 | 10 | 1700 | 0.5 | 0.2 |
| 0.8 | 40 | 1900 | 0.8 | 0.8 |
| 1.0 | 50 | 2100 | 1.0 | 1.0 |

The ratio of the minor axis "a" to the major axis "b" of the cross sections of the toner particles was 1:1.4. By using these toners, images were respectively produced in the same manner as in Example B1. As a result, images having almost the same quality as that of the images obtained in Example B1 were obtained.

EXAMPLE B3

The procedure in Example B1 was repeated except that the starting materials for the core particles used in Example B1 were changed to the following ones, and polybutylmethacrylate particles used in Example B1 as the resin particles were changed to polymethylmethacrylate particles, whereby toner particles were obtained.

| | |
|---|---|
| Styrene-acrylic copolymer | 58 parts by weight |
| $Fe_3O_4$ | 30 parts by weight |
| Polyethylene wax | 4 parts by weight |
| Nigrosine | 5 parts by weight |
| Charge-controlling agent | 3 parts by weight |

The ratio of the minor axis "a" to the major axis "b" of the cross section of the toner particle was 1:1.5.

Images were produced by using the toner particles and the apparatus shown in FIG. 5 in the same manner as in Example B1. As a result, images having almost the same quality as that of the images obtained in Example B1 were obtained.

EXAMPLE B4

(Preparation of Core Particles)

By using a mixture consisting of the following components, core particles containing waxes as main components were prepared in the following manner:

| | |
|---|---|
| Paraffin wax | 30% by weight |
| Polyethylene wax | 30% by weight |
| $Fe_3O_4$ | 38% by weight |
| Carbon black | 2% by weight |

The mixture was kneaded by a batch-type kneader, and roughly crushed after cooling. The crushed product was then finely pulverized by a jet pulverizer, followed by classification, thereby obtaining core particles with sizes between 5 μm and 25 μm (average particle size: 10 μm).

(Deposition of Resin Particles)

Resin particles, polybutylmethacrylate particles, were deposited on the surface of the above core particles in the same manner as in Example B1. However, the mechano-revolution number and the deposition time were changed to 800 rpm and 15 minutes, respectively. The particles thus obtained were observed by an electron microscope. As a result, it was confirmed that the resin particles were deposited on the surface of the core particle. Further, by the electron-microscopic observation of the cross section of the particle, it was also confirmed that the resin particles maintaining a spherical shape were slightly embedded in the core particle.

(Treatment with Solvent)

The particles thus obtained were brought into contact with a solvent, xylene, for 1.0 second in the following manner:

Namely, the core particles on which the resin particles had been deposited were jetted from a nozzle, over which xylene was mistily sprayed by a binary nozzle. The resin particles were dissolved by this to form a resin layer. Toner particles covered with the resin layer were thus obtained.

The toner particles thus obtained were free from agglomeration, and each particle was existing independently. The cross section of the toner particle was observed by an electron microscope. As a result, the core particle was found to be covered with a resin layer having a thickness of approximately 0.4 microns. On this toner was deposited silicon dioxide as a fluidity-improving agent. The ratio of the minor axis "a" to the major axis "b" of the cross section of the toner particle, which can show the spheroidicity of the toner particle, was 1:1.5.

(Image Developing Test)

By using the above toner, an image developing test was carried out in the same manner as in Example B1. As a result, images having almost the same quality as that of the images obtained in Example B1 were obtained. Moreover, a clear image was obtained even when a toner image was fixed on recording paper at a relatively low temperature of 120° C.

EXAMPLE B5

By using the core particles obtained in Example B4, toner particles having resin layers with various thicknesses were respectively obtained in the same manner as in Example B2. The amounts of the resin particles and the mechano-revolution numbers upon depositing the resin particles on the core particles were as shown in the below Table 3. The deposition was conducted for 15 minutes. Xylene was employed as the solvent.

TABLE 3

| Particle Size (μm) | Amount of Resin particles (parts by weight) | Mechano-Revolution Number (rpm) |
|---|---|---|
| 0.2 | 10 | 800 |
| 0.8 | 40 | 900 |
| 1.0 | 50 | 1000 |

The ratio of the minor axis "a" to the major axis "b" of the cross sections of the toner particles was 1:1.4.

By using these toners, images were respectively produced in the same manner as in Example B1. As a result, images having almost the same quality as that of the images obtained in Example B1 were obtained. As is clearly understood from the above, high quality images can be obtained by the development process of the present invention even when toner particles having core particles which contain waxes as main components and are relatively soft are employed.

EXAMPLE B6

The procedure in Example B4 was repeated except that the starting materials used in Example B4 for preparing the core particles were changed to the following ones, whereby toner particles were obtained.

| | |
|---|---|
| Microcrystalline wax | 20 parts by weight |
| Carnauba wax | 20 parts by weight |
| Ethylene-vinyl acetate copolymer | 18 parts by weight |
| $Fe_3O_4$ | 40 parts by weight |
| Carbon black | 2 parts by weight |

The ratio of the minor axis "a" to the major axis "b" of the cross section of the toner particle was 1:1.5.

By using the toner particles, an image forming test was carried out in the same manner as in Example B1. As a result, images having almost the same quality as that of the images obtained in Example B1 were obtained.

EXAMPLE B7

By using the same starting materials as in Example B1, core particles were prepared by means of spray drying. The starting materials were dispersed in toluene to obtain a dispersion containing 15 wt. % (solid basis) of the starting materials. The resulting dispersion was sprayed using a binary nozzle with application of a pressure of 2 kg/cm$^2$. The particles thus obtained were dried at a temperature of 30° C.

The dried particles were subjected to classification, thereby obtaining core particles with sizes between 5 μm and 20 μm (average particle size: 10 μm).

Toner particles were prepared by using the above core particles in the same manner as in Example B1. The toner particles thus obtained were almost the same as those obtained in Example B1. The ratio of the minor axis "a" to the major axis "b" of the cross section of the toner particle was 1:1.2. Further, images having almost the same quality as that of the images obtained in Example B1 were obtained by using the above toner particles.

EXAMPLE C1

(Preparation of Core Particles)

By using a mixture consisting of the following components, core particles were prepared in the following manner:

| | |
|---|---|
| Polyester resin | 56 parts by weight |
| $Fe_3O_4$ | 40 parts by weight |
| Carbon black | 1 part by weight |
| Polypropylene wax | 3 parts by weight |

The mixture was kneaded by a screw extruder, and roughly crushed after cooling. The crushed product was then finely pulverized by a jet pulverizer, followed by classification, thereby obtaining core particles with sizes between 5 μm and 20 μm (average particle size: 10 μm).

(Deposition of Resin Particles)

Particles of a methylmethacrylate-butylmethacrylate copolymer, having a particle size of 0.4 μm, were dispersed in water to obtain an aqueous dispersion containing 5 wt. % of the resin particles. The dispersion thus obtained and the above core particles were mixed, and the resulting mixture was milled by a ball mill, whereby the resin particles were deposited on the core particles. The mixture was then sprayed by a spray dryer, followed by drying. Core particles on which the resin particles are deposited were thus obtained.

The particles thus obtained were observed by an electron microscope. As a result, it was confirmed that the resin particles were deposited on the core particle.

(Treatment with Solvent)

The above core particles on which the resin particles had been deposited were brought into contact with a solvent, methyl ethyl ketone, in the following manner:

Namely, the core particles on which the resin particles had been deposited were jetted from a nozzle, over which methyl ethyl ketone was mistily sprayed by a binary nozzle. The resin particles were dissolved by this to form a resin layer. Toner particles covered with the resin layer were thus obtained.

The toner particles were free from agglomeration, and each particle was existing independently. The cross section of the toner particle was observed by an electron microscope. As a result, the core particle was found to be covered with the resin layer having a thickness of approximately 0.3 μm. The specific resistance of the toner particle was as sufficiently high as $10^{15}$ Ωcm, which was determined by the previously-mentioned pressure cell method. The angle of repose of the toner particles was 35 degrees. The ratio of the minor axis "a" to the major axis "b" of the cross section of the toner particle, which can show the spheroidicity of the toner particle, was 1:1.5.

(Image Developing Test)

An image developing test was carried out by using the above toner particles and an apparatus shown in FIG. 4. The material of the elastic blade was rustless steel, and that of the surface of the toner supporter was polyurethane containing magnetic powder. A line image of 600 DPI, a character image and a solid image were continuously produced on 10,000 sheets of recording paper. The 600 DPI-image was stably obtained without suffering from thickening of the line image, and the other images were also obtained without undergoing tailing or fogging. All the images obtained had a high optical density of 1.4 or more. Further, the latent image carrier itself was free from fogging, so that the amount of waste toner was largely decreased.

EXAMPLE C2

By using a mixture consisting of the following components, core particles were prepared in the same manner as in Example C1:

| | |
|---|---|
| Styrene-acrylic copolymer | 18 parts by weight |
| $Fe_3O_4$ | 40 parts by weight |
| Polyethylene wax | 4 parts by weight |
| Nigrosine | 5 parts by weight |
| Charge-controlling agent | 3 parts by weight |
| Amine-type silane coupling agent | 2 parts by weight |

Particles of a methylmethacrylate-butylmethacrylate-methacrylic acid copolymer, having a particle size of 0.4 μm, were deposited on the surface of the above core particles in the following manner:

The resin particles were dispersed in water to obtain an aqueous dispersion containing 5 wt. % of the resin particles. The dispersion thus obtained and the above core particles were mixed, followed by a coupling reaction at a temperature of 60° C. for 10 hours, whereby the resin particles were deposited on the surface of the core particles. The reaction mixture was dried by means of spray drying, and the resulting particles were treated with the solvent in the same manner as in Example C1, thereby obtaining toner particles.

The thickness of the resin layer of the toner particle was found to be 0.3 μm. The ratio of the minor axis "a" to the major axis "b" of the cross section of the toner particle was 1:1.5.

By using the toner thus obtained, images were produced in the same manner as in Example C1. As a result, images having almost the same quality as that of the images obtained in Example C1 were obtained.

EXAMPLE C3

By using a mixture consisting of the following components, core particles were prepared in the following manner:

| | |
|---|---|
| Styrene monomer | 20 parts by weight |
| n-Butylmethacrylate monomer | 30 parts by weight |
| Dimethylaminomethyl methacrylate monomer | 3 parts by weight |
| Channel black | 4 parts by weight |
| $Fe_3O_4$ | 40 parts by weight |
| Polypropylene wax | 3 parts by weight |
| Benzoyl peroxide | 0.04 parts by weight |

The above mixture was added to a 3% aqueous solution of carboxymethyl cellulose, followed by suspension polymerization and dialysis, whereby an aqueous dispersion of the core particles was obtained. The aqueous dispersion thus obtained was added to a 2% aqueous dispersion of particles of a methyl-methacrylate-butylmethacrylate-methacrylic acid copolymer obtained by emulsion polymerization, having a particle size of 0.3 μm, and the resulting mixture was stirred for 24 hours. The resin particles were thus deposited on the core particles by means of hetero agglomeration. The reaction mixture was then subjected to spray drying, thereby obtaining toner particles covered with a resin layer. The thickness of the resin layer was 0.2 μm. The ratio of the minor axis "a" to the major axis "b" of the cross section of the toner particle was 1:1.0.

By using the toner particles, an image developing test was carried out in the same manner as in Example C1. As a result, images having almost the same quality as that of the images obtained in Example B1 were obtained.

EXAMPLE C4

By using a mixture consisting of the following components, core particles containing waxes as main components were prepared in the following manner:

| | |
|---|---|
| Paraffin wax | 30 parts by weight |
| Polyethylene wax | 30 parts by weight |
| $Fe_3O_4$ | 38 parts by weight |
| Carbon black | 2 parts by weight |

The mixture was kneaded by a batch-type kneader, and roughly crushed after cooling. The crushed product was then finely pulverized by a jet pulverizer, followed by classification, thereby obtaining core particles with sizes between 5 μm and 25 μm (average particle size: 10 μm).

By using the core particles, toner particles were prepared in the same manner as in Example C1.

The toner particles thus obtained were free from agglomeration, and each particle was existing independently. The cross section of the toner particle was observed by an electron microscope. As a result, it was confirmed that the core particle was covered with a resin layer having a thickness of approximately 0.3 microns. On the toner particles was deposited silicon dioxide as a fluidity improving agent. The ratio of the minor axis "a" to the major axis "b" of the cross section of the toner particle was 1:1.5.

By using the toner thus obtained, an image developing test was carried out in the same manner as in Example C1. As a result, images having almost the same quality as that of the images obtained in Example C1 were obtained. Moreover, a clear image was obtained even when a toner image was fixed on recording paper at a relatively low temperature of 120° C.

EXAMPLE D1

The resin particles were deposited on the core particles in the same manner as in Example B1.

The resulting particles were sprayed by a nozzle in hot air under the following conditions:

Temperature of hot air: 300° C.

Amount of hot air: 150 l/min

Supplying rate of the particles: 200 g/hr

Amount of air used upon supplying the particles: 7 l/min

The toner particles thus obtained were free from agglomeration, and each particle was existing independently. The cross section of the toner particle was observed by an electron microscope. As a result, it was confirmed that the core particle was covered with a resin layer having a thickness of approximately 0.4 microns. The specific resistance of the toner particles was as sufficiently high as $10^{15}$ Ωcm, which was determined by a pressure cell method. The angle of repose of the toner particles was 35 degrees. The ratio of the minor axis "a" to the major axis "b" of the cross section of the toner particle, which can show the spheroidicity of the toner particle, was 1:1.3.

An image developing test was carried out by using the toner particles and an apparatus shown in FIG. 4. The material of the elastic blade was rustless steel, and that of the surface of the toner supporter was polyurethane containing magnetic powder. A line image of 600 DPI, a character image and a solid image were continuously produced on 10,000 sheets of recording paper. The 600 DPI-image was stably obtained without suffering from thickening of the line image, and the other images were also obtained without undergoing tailing or fogging. All the images obtained had a high optical density of 1.4 or more. Further, the latent image carrier itself was free from fogging, so that the amount of waste toner was largely decreased.

EXAMPLE D2

Toner particles were prepared in the same manner as in Example B2 except that the core particles on which the resin particles had been deposited were sprayed in hot air instead of subjecting them to the treatment with the solvent. The treatment with hot air was carried out under the conditions shown in the below Table 4.

As a result, toner particles covered with a resin layer each having a thickness shown in the Table were obtained.

TABLE 4

| Particle Size (μm) | Amount of Air Used When Supplying Particles (l/min) | Temperature of Hot Air (°C.) | Thickness of Resin Layer (μm) | Sphero-idicity (b/a) |
|---|---|---|---|---|
| 0.2 | 6 | 300 | 0.2 | 1.3 |
| 0.8 | 10 | 400 | 0.7 | 1.3 |
| 1.0 | 12 | 500 | 0.9 | 1.3 |

By using the toner, particles, images were produced in the same manner as in Example D1. As a result, images having almost the same quality as that of the images obtained in Example D1 were obtained.

EXAMPLE D3

The procedure in Example B3 was repeated except that the core particles on which the resin particles had been deposited were treated with hot air under the same conditions as in Example D1 instead of subjecting them to the treatment with the solvent, thereby obtaining toner particles. The ratio of the minor axis "a" to the major axis "b" of the cross section of the toner particle was 1:1.3.

Images were produced in the same manner as in Example D1 by using the above toner particles. As a result, images having almost the same quality as that of the images obtained in Example B1 were obtained.

EXAMPLE D4

The procedure in Example B4 was repeated except that the core particles on which the resin particles had been deposited were treated with hot air under the same conditions as in Example D1 instead of subjecting them to the treatment with the solvent, thereby obtaining toner particles. The toner particles thus obtained were free from agglomeration, and each particle was existing independently. The cross section of the toner particle was observed by an electron microscope. As a result, it was confirmed that the core particle was covered with the resin layer having a thickness of approximately 0.4 μm. The ratio of the minor axis "a" to the major axis "b" of the cross section of the toner particle was 1:1.1.

By using the toner particles, images were produced in the same manner as in Example D1. As a result, images having almost the same quality as that of the images obtained in Example D1 were obtained. Moreover, a clear image was also obtained even when a toner image was fixed on recording paper at a relatively low temperature of 120° C.

EXAMPLE D5

The procedure in Example B6 was repeated except that the core particles on which the resin particles had been deposited were treated with hot air under the same conditions as in Example D1 instead of subjecting them to the treatment with the solvent, thereby obtaining toner particles. The ratio of the minor axis "a" to the major axis "b" of the cross section of the toner particle was 1:1.1.

By using the toner particles, images were produced in the same manner as in Example D1. As a result, images having almost the same quality as that of the images obtained in Example D1 were obtained. Moreover, a clear image was also obtained even when a toner image was fixed on recording paper at a relatively low temperature of 120° C.

EXAMPLE 6

The procedure in Example C1 was repeated except that the core particles on which the resin particles had been deposited were treated with hot air under the same conditions as in Example D1 instead of subjecting them to the treatment with the solvent, thereby obtaining toner particles.

The toner particles thus obtained were free from agglomeration, and each particle was existing independently. The cross section of the toner particle was observed by an electron microscope. As a result, it was confirmed that the core particle was covered with a resin layer having a thickness of approximately 0.3 μm. The ratio of the minor axis "a" to the major axis "b" of the cross section of the toner particle was 1:1.3.

By using the toner particles, images were produced in the same manner as in Example D1. As a result, images having almost the same quality as that of the images obtained in Example D1 were obtained.

EXAMPLE D7

The procedure in Example B2 was repeated except that the core particles on which the resin particles had been deposited were treated with hot air under the same conditions as in Example D1 instead of subjecting them to the treatment with the solvent, thereby obtaining toner particles.

The toner particles thus obtained were free from agglomeration, and each particle was existing independently. The cross section of the toner particle was observed by an electron microscope. As a result, it was confirmed that the core particle was covered with a resin layer having a thickness of approximately 0.3 μm. The ratio of the minor axis "a" to the major axis "b" of the cross section of the toner particle was 1:1.3.

By using the toner particles, images were produced in the same manner as in Example D1. As a result, images having almost the same quality as that of the images obtained in Example D1 were obtained.

What is claimed is:

1. An apparatus for developing an image by using spherical toner particles, comprising:

a latent image carrier on which a latent image is formed by a potential contrast;

a toner transporter having a surface for transporting spherical toner particles to the latent image carrier; and an elastic blade having a surface for passing the spherical toner particles transported by the toner transporter through a gap between the surfaces of the toner transporter and elastic blade thereby forming a thin toner layer which is charged, wherein the toner transporter is elastically deformed for the surface thereof to be brought into pressure contact with the latent image carrier and develop an electrostatic latent image on the latent image carrier with the thin toner layer which is charged, wherein surface roughnesses of the elastic blade and of the toner transporter are different from each other, and wherein the toner particles are rotated between the elastic blade and the toner transporter and charged electrostacially.

2. An apparatus as claimed in claim 1, wherein each of the spherical toner particles is a magnetic toner particle, and the toner transporter comprises a magnetic field generating layer in the vicinity of its surface.

3. An apparatus as claimed in claim 1, wherein each of the spherical toner particles is a microcapsulated toner particle comprising a core particle and a shell which encloses the core particle, the shell being made from a material which belongs to a frictional electrification series different from a frictional electrification series of a material of at least one of the surfaces of the toner transporter and the elastic blade.

4. An apparatus as claimed in claim 3, wherein the spherical toner particle is a magnetic toner particle comprising a magnetic powder which is unexposed to the outside of the shell.

5. An apparatus as claimed in claim 3, wherein the shell is a resin layer.

6. An apparatus as claimed in claim 1, wherein the elastic blade has a surface which is rougher than that of the toner transporter.

7. An apparatus as claimed in claim 1, wherein the toner transporter has a surface on which the toner particle can easily slide.

8. An apparatus as claimed in claim 1, wherein the elastic blade has a surface on which the toner particle can not easily slide.

9. An apparatus as claimed in claim 1, wherein the rotating direction of the toner particle is different from that of the toner transporter.

10. An apparatus as claimed in claim 1, wherein the toner particle can not pass between the toner transporter and the elastic blade in a short time.

11. An apparatus as claimed in claim 1, wherein the spherical toner particle satisfies the equation of b/a=1 to 1.5 where "a" is the length of the minor axis and "b" is the length of the major axis of the cross section of the toner particle.

12. An apparatus for developing an image by using spherical toner particles, comprising:

a latent image carrier on which a latent image is formed by a potential contrast;

a toner transporting means having a surface for transporting spherical toner particles to the latent image carrier; and a toner regulating means for passing the toner particles transported by the toner transporting means through a gap between the surface of the toner transporting means and a surface of the toner regulating means, thereby forming a thin toner layer which is charged, wherein the toner transporting means is elastically deformed for the surface thereof to be brought into pressure contact with the latent image carrier and develop an electrostatic latent image formed on the latent image carrier with the thin toner layer which is charged, wherein roughnesses of the surfaces of the toner regulating means and of the toner transporting means are different from each other, and wherein the toner particles are rotated between the toner regulating means and the toner transporting means and charged electrostatically.

13. An apparatus as claimed in claim 12, wherein at least some of the spherical toner particles are magnetic toner particles and the toner transporting means comprises a magnetic field generating layer in the vicinity of its surface.

14. An apparatus as claimed in claim 12, wherein at least some of the spherical toner particles are microcapsulated toner particles each comprising a core particle and a shell which at least partly encloses the core particle, the shell being made from a material which belongs to a frictional electrification series different from a frictional electrification series of a material of at least one of the surface of the toner supporting means and a surface of the toner regulating means.

15. An apparatus as claimed in claim 14, wherein each core particle is a magnetic toner particle comprising a magnetic powder which is fully enclosed in the shell.

16. An apparatus as claimed in claim 14, wherein the shell is a resin layer.

17. An apparatus as claimed in claim 12, wherein the toner regulating means has a surface which is rougher than that of the toner transporting means.

18. An apparatus as claimed in claim 12, wherein the toner particles can easily slide on the surface of the toner transporting means.

19. An apparatus as claimed in claim 12, wherein the toner particles cannot easily slide on the surface of the toner regulating means.

20. An apparatus as claimed in claim 12, wherein the toner transporting means is rotated in one direction and the rotation of the toner particles is in a direction different from the one direction of the rotation of the toner transporting means.

21. An apparatus as claimed in claim 12, wherein the toner particles cannot pass between the toner transporting means and the toner regulating means in a short time.

22. An apparatus as claimed in claim 12, wherein at least some of the toner particles satisfy the equation b/a=1 to 1.5 where "a" is the longest length of the minor axis and "b" is the longest length of the major axis of at least one cross section of the toner particles.

* * * * *